US006614336B2

(12) United States Patent
Galli

(10) Patent No.: US 6,614,336 B2
(45) Date of Patent: Sep. 2, 2003

(54) ROTARY SWITCH MECHANISM

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 0 days.

(21) Appl. No.: 10/308,440

(22) Filed: Dec. 3, 2002

(65) Prior Publication Data

US 2003/0106782 A1 Jun. 12, 2003

Related U.S. Application Data

(60) Provisional application No. 60/338,894, filed on Dec. 10, 2001, and provisional application No. 60/402,172, filed on Aug. 9, 2002.

(51) Int. Cl.[7] ..... H01H 9/00
(52) U.S. Cl. ..... 335/205; 335/206
(58) Field of Search ..... 335/205–208

(56) References Cited

U.S. PATENT DOCUMENTS 3,614,683 A * 10/1971 Porter ..... 335/152
4,131,771 A * 12/1978 Erickson et al. ..... 200/11 DA
4,389,627 A * 6/1983 Uesugi et al. ..... 335/206
4,408,101 A * 10/1983 Brodbeck ..... 379/355.09

* cited by examiner

*Primary Examiner*—Ramon M. Barrera
(74) *Attorney, Agent, or Firm*—Barlow, Josephs & Holmes, Ltd.

(57) ABSTRACT

A novel construction for a multifunctional rotary switching device is provided. The body of the switch includes a radial array of switching contact arms, each arm being connected at one end to a central hub. The switch is preferably stamped from a thin sheet of flexible metallic material having magnetic characteristics. The switch is then installed onto a printed circuit board switching substrate with the central hub of the switch being rigidly connected to the switching substrate with the contact arms in a normally closed state. A magnet is installed into a rotatable actuator in close proximity to the surface of the switch whereby the magnetic force of the lifts the contact arm of the switch over which the magnet is aligned. In this position, the magnet opens the corresponding contact arm of the switch.

18 Claims, 6 Drawing Sheets

ROTARY SWITCH MECHANISM

CROSS-REFERENCE TO RELATED APPLICATIONS

This application is related to and claims priority from earlier filed provisional patent application No. 60/338,894, filed Dec. 10, 2001 and earlier filed provisional application No. 60/402,172, filed Aug. 9, 2002.

BACKGROUND OF THE INVENTION

The present invention relates to a new rotary switch mechanism that employs a reduced number of operational components as compared to the prior art. More specifically, this invention relates to an improved rotary switch mechanism that is formed from a thin metallic material and is selectibly operable using a magnet.

The prior art provides various types of multiple position rotary switches for use in connection with electrical devices. One example of a prior art multiple position rotary switch may be found in Erickson, et al., U.S. Pat. No. 4,131,771. The Erickson, et al. switch includes a switch body shaped like a wheel attached to the end of a shaft. The wheel is mounted within a housing between a pair of circuit boards. A spring loaded detent in the wall of the housing engages serrations provided along the outer diameter of the wheel in order to provide tactile feed back and retain the wheel in the desired preset positions that operate the switch functions. The top and bottom of the wheel each include a plurality of brushes that contact pads that correspond to circuit traces formed on the circuit boards as the shaft rotates the wheel. During assembly of the switch, after the circuit boards are properly aligned with the wheel sandwiched therebetween, pins in the housing are melted in order to permanently secure the boards in position relative to one another and the wheel orientation. As the wheel is rotated, the brushes align with contact pads on the circuit boards thereby energizing the corresponding circuits. This type of configuration however is comparatively bulky and requires a great deal of space within a compact electronic device. Further, because of the brush style contacts, the potential for failure of the contacts is high.

Another example of a prior art switch may be found in the Model 77 Multimeter produced by John Fluke Mfg., Co., Inc. of Everett, Wash. The switch utilized in this device comprises a circular non-conductive stationary disk having a plurality of posts mounted on each of its major surfaces. A smaller rotatable disk is provided in the center of the stationary disk. Each side of the rotatable disk includes a pair of contacts that serve to complete connections between the posts located on each side of the stationary disk as the rotational disk is rotated. The posts are electrically connected to the main circuit board of the device and are permanently held in position upon the stationary disk by rivets.

The prior art further provides an electrical device distributed by the Actron Manufacturing Company. The electrical device includes a switch mechanism having a race that is integrally formed into the top cover of the electrical device. The top cover includes an opening through which a portion of the knob of the switch mechanism extends. The race extends around the entire diameter of the opening along the inside surface of the top cover. The knob is retained within the opening by a circuit board that is mounted to the top cover such that a portion of the knob is sandwiched between the circuit board and the race. The circuit board includes both the circuit traces, which serve to electrically interconnect the electrical components mounted upon the board and the switching circuit, which provides the electronic switching functions for the device. The race includes a plurality of spaced arcuate protrusions that form multiple peaks and valleys along the race. The knob comprises a cylindrical disk having on one surface a handle and at the opposite surface a protruding rim. The rim includes a first and second pair of diametrically opposed upstanding platforms. The first platforms are of sufficient size that rotation of the knob, the first pair of platforms glide along the peaks of the protrusions. The second platforms each include a socket for receiving a spring and a ball bearing. The bearing is located on top of the spring such that the ball bearing is sandwiched between the spring and the race. The spring provides a biasing force that retains the bearing against the race such that as the knob is rotated, the bearing aligns itself in the valleys of the race thereby mechanically stabilizing the knob in preselected positions. Between the preselected positions, the bearing is received within the socket so as to allow the bearing to slide over the top or peaks of the protrusions. The knob includes along its opposite end a plurality of wiping members that rotate with the knob and contact the switching circuit thereby selectively closing the switching circuit as the knob is rotated to preselected positions. In this electrical device, again brushes or wipers are included causing constant rubbing of the switching elements during operation of the switch of the changing of the switch orientation.

As an attempt to eliminate the need for brushes and to reduce the constant movement of the contact elements within the switch, multifunctional switching in compact spaces is often accomplished using reed switches. To actuate the switch a magnetic force is applied near the switch moving an actuator arm into contact with a secondary contact arm thereby greatly reducing the operational range of movement of the device. These devices however have a significant dimensional component in all three dimensions. In addition, as a function of the way in which they are constructed, a magnetic force applied proximate to the switch from any direction could potentially operate the switch. This is an undesirable feature in flashlight construction where an external magnet in the proximity of the flashlight may cause it to operate or even malfunction. Reed switches are also quite fragile and care must be taken in handling the component when assembling it into the overall flashlight assembly so as not to damage the operation of the device resulting in a defective end product. This problem is amplified where the desired end product requires a multifunction capability, thus requiring several individual reed switches to be installed to create the multifunctional relationship. Finally, because reed switches are complex they are costly to manufacture thus increasing the cost of the end product.

There is therefore a need for a simple, compact device that has limited moving components, that is rugged and that is capable of multifunctional switching. In addition, there is a need for a cost effective alternative to reed switches that provide a compact multifunctional switching solution.

BRIEF SUMMARY OF THE INVENTION

In this regard, in accordance with the present invention, a novel construction for a multifunctional rotary switching device is provided. The body of the switch includes a radial array of switching contact arms, each arm being connected at one end to a central hub. The switch is preferably stamped from a thin sheet of flexible metallic material having magnetic characteristics. The metallic material has a sufficient thickness dimension that causes the material to have an internal spring bias causing the arms of the switch to remain in a normally flat position, i.e. the arms stay normally aligned with the plane of the central hub. Each of the contact arms of the switch, on the end opposite the hub, may have an increased width dimension (bump or shoulder) to provide an enlarged contact area wherein the switch arm contacts the respective switch circuit traces as shown in the drawings.

The switch of the present invention is then installed onto a printed circuit board switching substrate in the preferred embodiment. The central hub of the switch is rigidly connected to the switching substrate and an electrical connection is made thereto, providing a common electrical connection to each of the switching arms. On the switching substrate, at locations that correspond to the contact end of each of the switching arms, is a contact pad that the contact end of each arm comes into contact with in the relaxed, normally closed state. Further, a magnet is installed into a rotatable actuator in close proximity to the surface of the switch of the present invention. The magnetic force of the magnet mounted in the actuator lifts the contact arm of the switch over which the magnet is aligned. In this position, the magnet opens the corresponding contact arm of the switch.

A microprocessor device is provided on the switching substrate that periodically samples the electrical contact at each of the contact pads of the switch. Upon the opening of one of the normally closed contacts, the microprocessor senses the open circuit and performs an instruction that corresponds to that contact being open.

A second embodiment of the switch of the present invention provides for a switch that has the contact arms bent at a perpendicular angle to the central hub. This embodiment creates a cup shaped switch configuration that can be installed into the barrel of a cylindrical flashlight handle.

Accordingly, one of the objects of the present invention is the provision of a rotatable, multi-function switch that has enhanced functioning. Another object of the present invention is the provision of a compact, lightweight, low cost rotary switch mechanism having a reduced number of operational components. Yet another object of the present invention is the provision of a compact rotary, multi-function switch mechanism that is easily manufactured and assembled from low cost components. A further object of the present invention is the provision of a rotary switch that has operating characteristics that allow the device to be installed in either a flat or tubular configuration using the same operational components.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
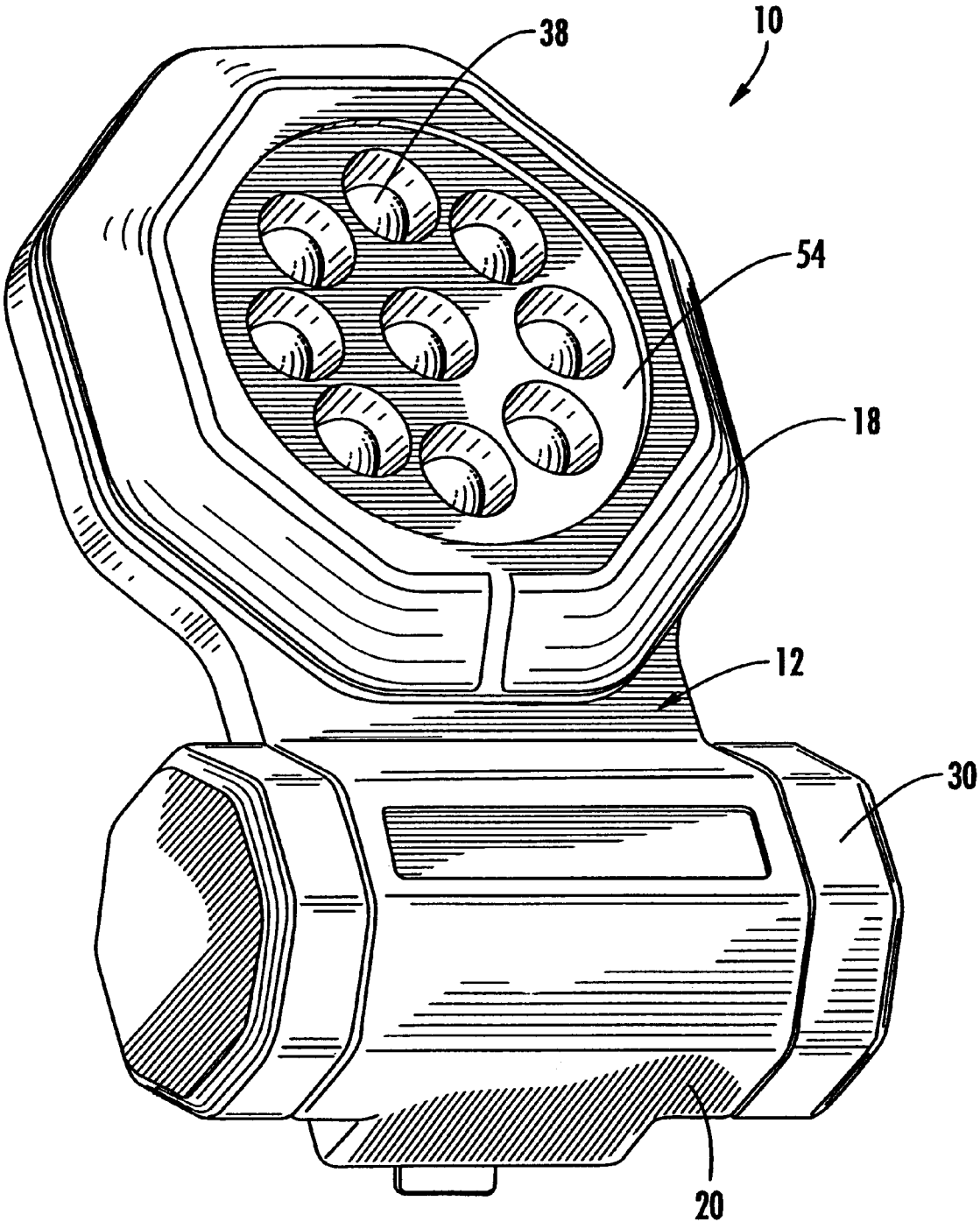
FIG. 1 is a perspective view of a flashlight incorporating the rotary switch of the present invention.

Referring now to the drawings, the preferred embodiment of the rotary switch assembly of the present invention is illustrated and generally indicated in connection with a flashlight 10 in FIGS. 1–4*a*. Further, a second embodiment of the rotary switch is also shown in connection with a traditionally shaped linear flashlight 100 in FIG. 5. While specific structure is shown utilizing the switch of the present invention within a flashlight, it should be understood by one skilled in the art that the rotary switch of the present invention has broad application that is not limited to use within flashlights. Specifically, the present invention is directed toward a rotary switch for use in any application where multi-functional switching is required.

Turning now to FIG. 1 a flashlight 10 incorporating the switch of the present invention is shown. The flashlight 10 includes an outer housing 12 that encloses the operable elements of the flashlight 10 and the switch assembly. The face of the housing 12 includes openings through which the lighting elements protrude and a compartment at the bottom for containing a battery. The bezel of the housing is rotatably mounted to the housing to allow it to operate as an actuator as will be further described below. While a circular array of nine lighting elements is shown in a circular pattern, it can be appreciated that any number of arrangement of lighting elements could be used and still fall within the scope of the present disclosure.

Figure 2:
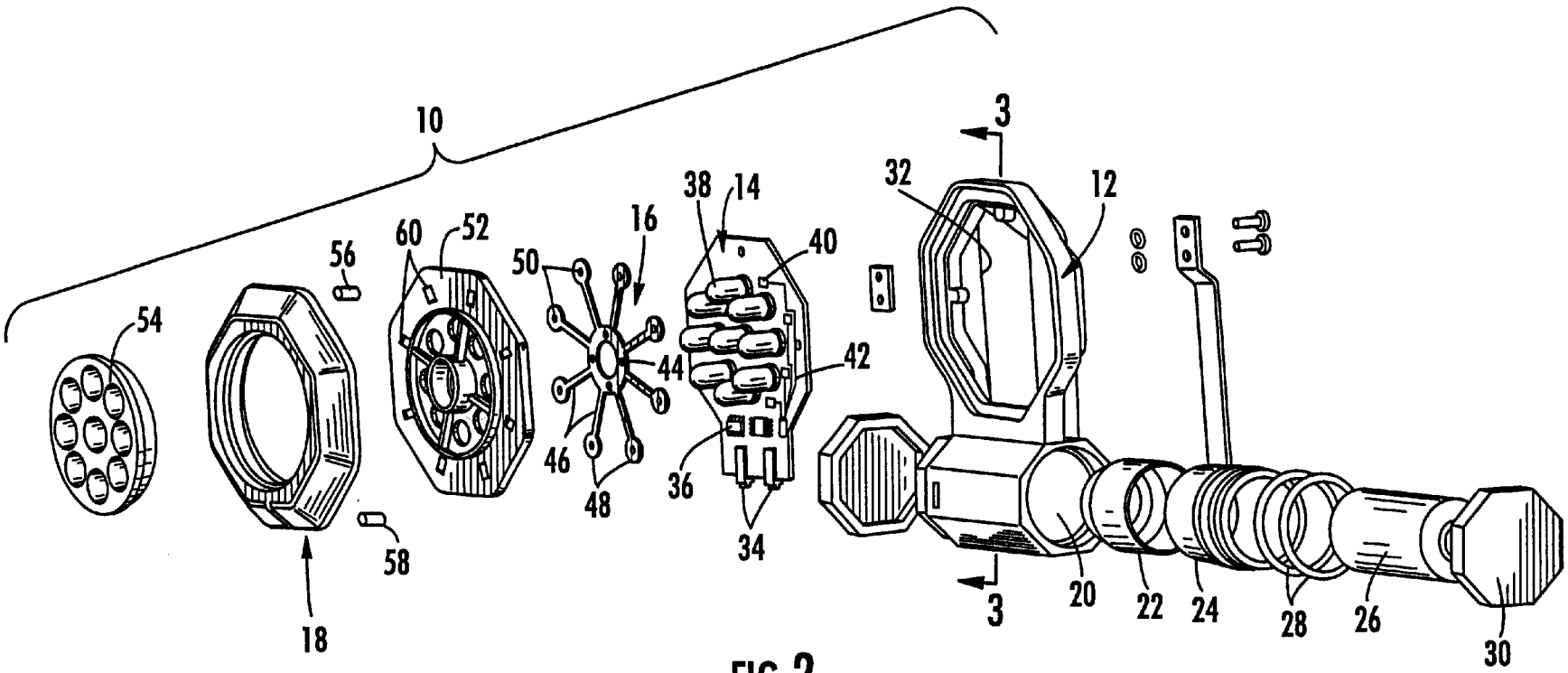
FIG. 2 is an exploded perspective view thereof.

FIG. 2 illustrates an exploded perspective view of the flashlight 10 and rotary switch mechanism of the present invention. The key elements of the switch are all shown in their relative positions to one another and include the base 14, the contact element 16 and the actuator 18. The operable elements are all assembled and installed into the outer housing 12 to form a completed flashlight 10. The housing 12 can be seen to have two interior compartments. The lower compartment 20 receives two metallic contact sleeves 22,24 that are cylindrically shaped, each having one closed end and shaped to hold a battery 26. One end of the battery 26 is in electrical communication with one of the contact sleeves 22 and the other end of the battery 26 is in electrical communication with the second contact sleeve 24. More specifically, the positive terminal of the battery 26 is in contact with the end wall of one contact sleeve 22 thereby making the entire sleeve 22 an extension of the positive terminal of the battery 26 and the negative terminal of the battery 26 is in contact with the end wall of the other contact sleeve 24 thereby making the entire sleeve 24 an extension of the negative terminal of the battery 26. Once the battery 26 is placed within the compartment 20, O-rings 28 and a threaded cover 30 are received over the end of the compartment 20 to retain the battery 26 and create a watertight seal over the compartment 20.

The base 14 is then received within the second compartment 32 of the housing 12. The base 14 is preferably formed as a printed circuit board and becomes the central operational element around which the rotary switch of the present invention is built. At the bottom edge of the base 14 are two spring biased electrical contacts 34 that extend downwardly within the housing 32. Once the flashlight 10 is fully assembled, the spring contacts 34 pass through two openings provided between the upper compartment 32 and the lower compartment 20 and in are in electrical communication with the two metallic contact sleeves 22,24 within the lower compartment 20 of the housing 12. In this manner, energy from the battery 26 travels from the battery 26 through each of the contact sleeves 22,24 respectively and into the base 14 through the electrical contacts 34 thereby providing positive and negative power from the battery 26 to the components installed on the base 14.

The base 14 is preferably formed as a printed circuit board and configured to support the electronics 36, lighting elements 38 and contact pads 40 required to make the flashlight 10 operable. The key elements of the base 14 include the contact springs 34 that draw power from the battery 26, the circuit traces 42 that direct power to the various components mounted thereon, the contact element pads 40 and the control circuitry 36 as will be more fully described below. The circuit traces 42 on the base 14 include small contact pads 40 that are distributed in an array over the face of the base 14. The contact pads 40 are simply exposed areas in the trace 42 where another contact can be selectively brought into or out of electrical communication with the contact pad 40. The contact pads 40 also may further include a small bead of solder to create a contact pad 40 that is slightly raised from the surface of the face of the base 14.

The objects to be controlled by the switch of the present invention are also connected to the base 14. In the case of the flashlight 10 of the preferred embodiment, an array of lighting elements 38 to be controlled by the switch of,the present invention are mounted directly onto the base 14 with their respective leads in electrical communication with the circuit traces 42 also formed thereon. The lighting elements 38 incorporated into the present invention are preferably light emitting diodes (LEDs), however, it should be understood that because of their identical shape, configuration and form factor, conventional filament type miniature lamps could be interchangeably substituted for the LEDs. Further, while a circular array of lighting elements 38 and contact pads 40 is shown, the disclosure of the present invention is also intended to include any array of lighting elements 38 and contact pads 40 including but not limited to square, rectangular, cylindrical and/or linear.

The contact element 16 is also mounted onto the base 14. The contact element 16 generally has a common hub portion 44 with a radial array of contact arms 46 extending therefrom. The contact arms 46 are all connected to and in common electrical communication with the hub 44. Each of the contact arms 46 may include an area 48 at its free end having an increased dimension to create an enlarged contact surface. This enlarged area 48 is shown as a circular pad at the end of each contact arm 46. While this feature is helpful to overcome manufacturing tolerances, it is not a required element of the present invention. Similarly, the end of each contact arm may include a small punched dimple 50 to further enhance the contact between the contact arm 46 and the contact pads 40 on the base 14. If provided, the dimple 50 comes into contact with the switching contact pad 40 before the arm 46 reaches a completely relaxed normal state. Due to the dimple 50 holding the arm 46 in a slightly elevated position, the spring bias in the arm 46 increases the contact force between the dimple 50 and the contact pad 40 providing improved electrical contact. The contact element 16 is preferably formed as a single piece being stamped from a thin sheet of metallic, electrically conductive material. Further, it is preferable, that the metallic material has resilient properties to provide each of the contact arms 46 with a natural spring bias. It is also important that the material selected be of a ferro-magnetic type material to allow the contact arms 46 to be deflected by a magnet as will be described below. While not required, after the contact element 16 is stamped from a ferro-magnetic material, it may be further plated with a more highly conductive material to enhance its functioning within the switch of the present invention.

The contact element 16 is mounted to the base 14 by fastening the hub 44 onto the face of the base 14. In this manner, the hub 44 is placed into electrical communication with a circuit trace 42 on the base 14 providing a common electrical connection to the hub 44 and each of the fixed ends of the contact arms 46. When installed in this position, with the hub 48 fastened directly to the face of the base 14, the contact ends 48 of the contact arms 46 rest on the contact elements 40 and are slightly deflected from their normal relaxed plane, thereby causing the spring bias in the contact arm 46 to maintain a firm, normally closed position at each of the contact arm 46 -contact element 40 interfaces.

Once the fully assembled base 14 is installed into the second compartment 32 of the housing, a faceplate 52 is installed with openings through which the lighting elements 38 protrude. The faceplate 52 is sealed onto the housing 12 and the openings around each of the lighting elements 38 are sealed creating a waterproof flashlight housing 12. Finally, a bezel 18 is rotatably installed and retained in place by a central hub 54. The rotatable bezel 18 includes a spring loaded ball detent 56 and a magnet 58 installed in the back thereof. The ball detent 56 engages grooves 60 provided in the faceplate 52 to provide tactile feedback to the user of the light when rotating the flashlight bezel 18. The tactile feedback notifies the operator that the bezel 18 is in one of the several operational positions and serves to retain the bezel 18 in the desired position until intentionally moved by the operator.

Figure 3:
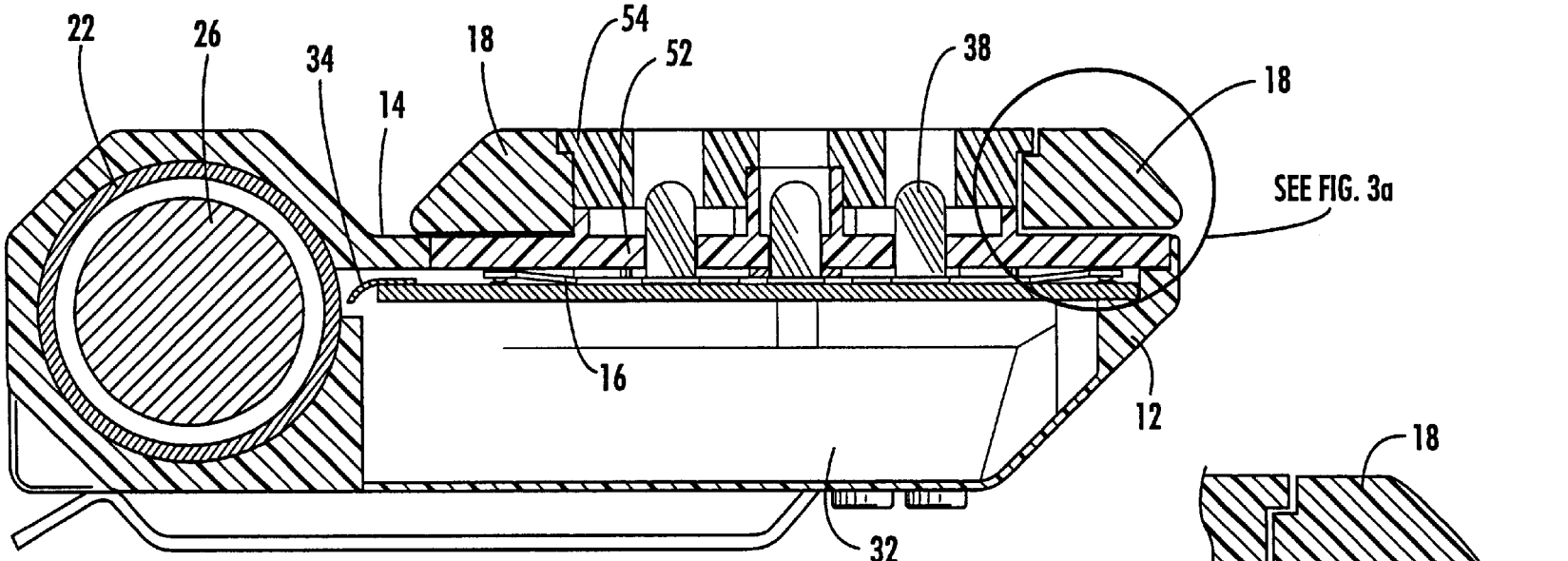
FIG. 3 is a cross-sectional view along line 3—3 of FIG. 2 with the contact element in the normally closed position.
Figure 3A:
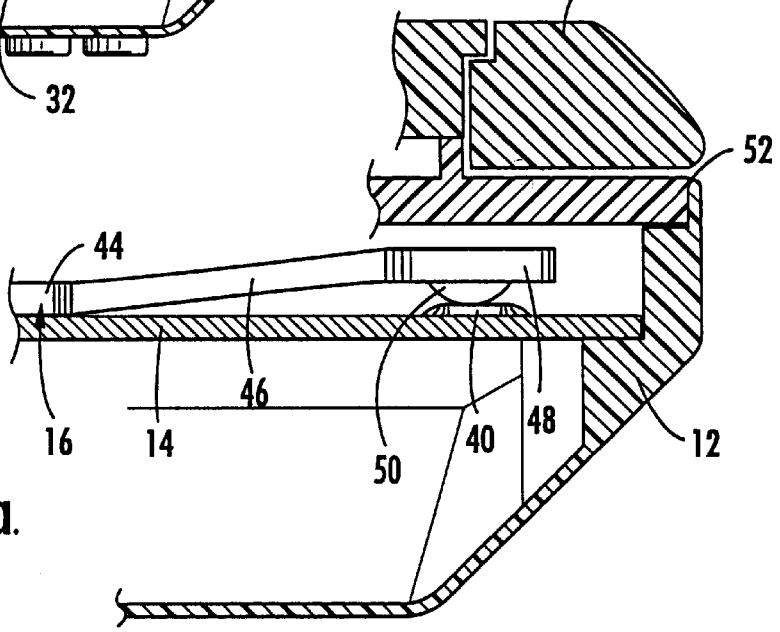
FIG. 3*a* is an exploded view of the contact element of FIG. 3.
Figure 4:
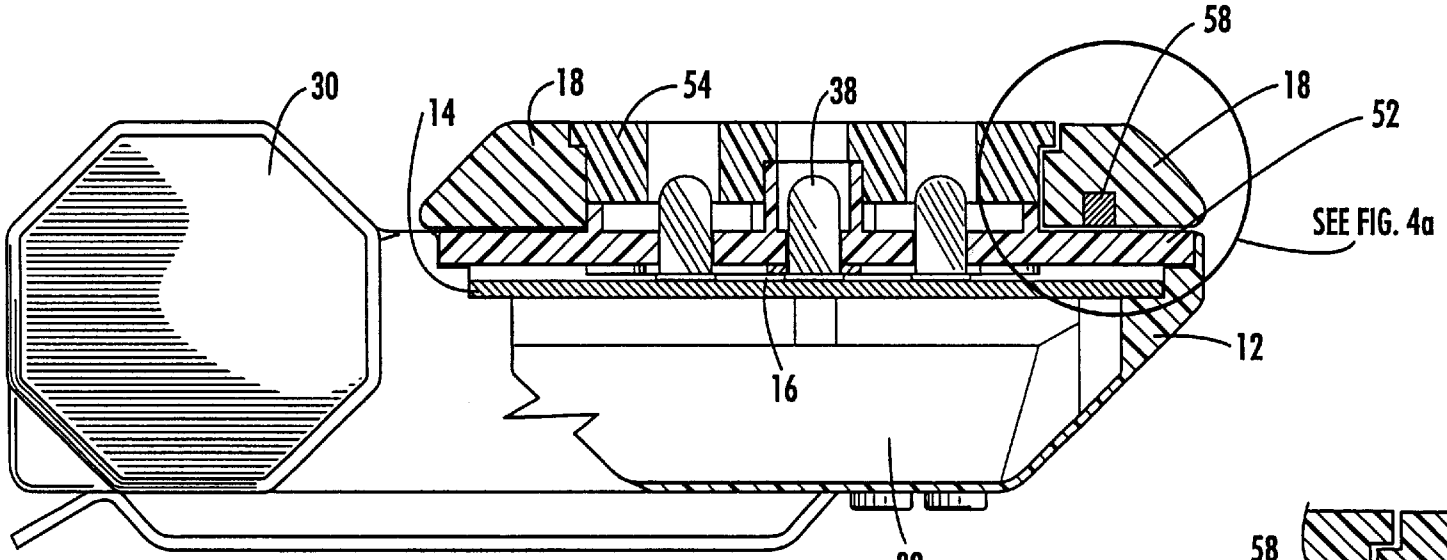
FIG. 4 is a cross-sectional view along line 3—3 of FIG. 2 with the contact element in the open position.
Figure 4A:
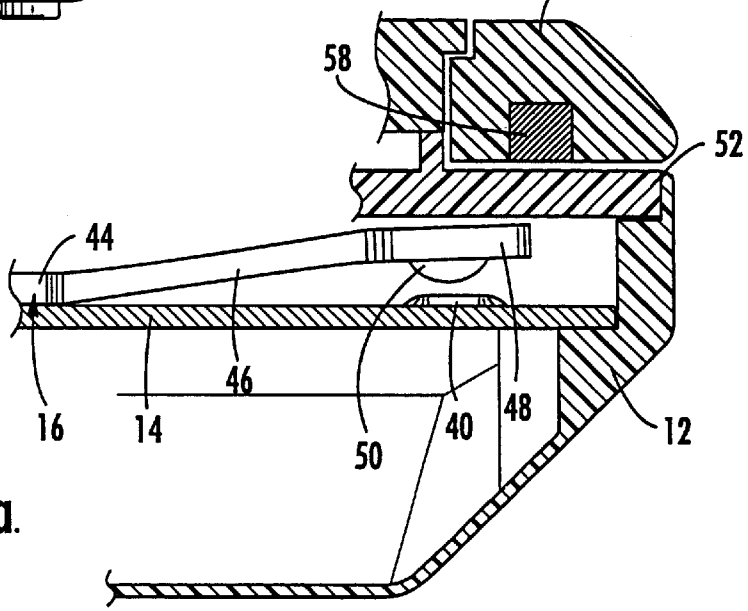
FIG. 4*a* is an exploded view of the contact element of FIG. 4.

Turning now to FIGS. 3–4*a*. The flashlight of the present invention is shown in cross-section to illustrate the functioning of the switch. In this view, it can be seen that the bezel 18 serves as an actuator for the flashlight 10. This actuator function is accomplished by the small magnet 58 mounted therein. As can best be seen in FIGS. 3 and 3*a* the switch is shown in the normally closed position. The contact arm 46 is in the relaxed state where the contact end 48 of the arm 46 is in firm contact with the contact pad 40 on the base 14. The cross-sectional view of the bezel 18 shows that the magnet 58 is not in a position above the contact arm 46. FIGS. 4 and 4*a* show the bezel 18 rotated into a position where the magnet 58 is positioned above the contact arm 46 in an operable position. Because the contact arms 46 are formed from a ferro-magnetic material, with the magnet 58 in the position shown, the magnetic force attracts the particular contact arm 46 located directly beneath the magnet 58, lifting it from the contact pad 40 on the switch body 14 thereby opening that particular circuit. When the bezel 18 is again rotated and the magnet 58 is moved to the next position, the spring bias in the contact arm 46 causes it to return to its relaxed, normally closed position.

Figure 6:
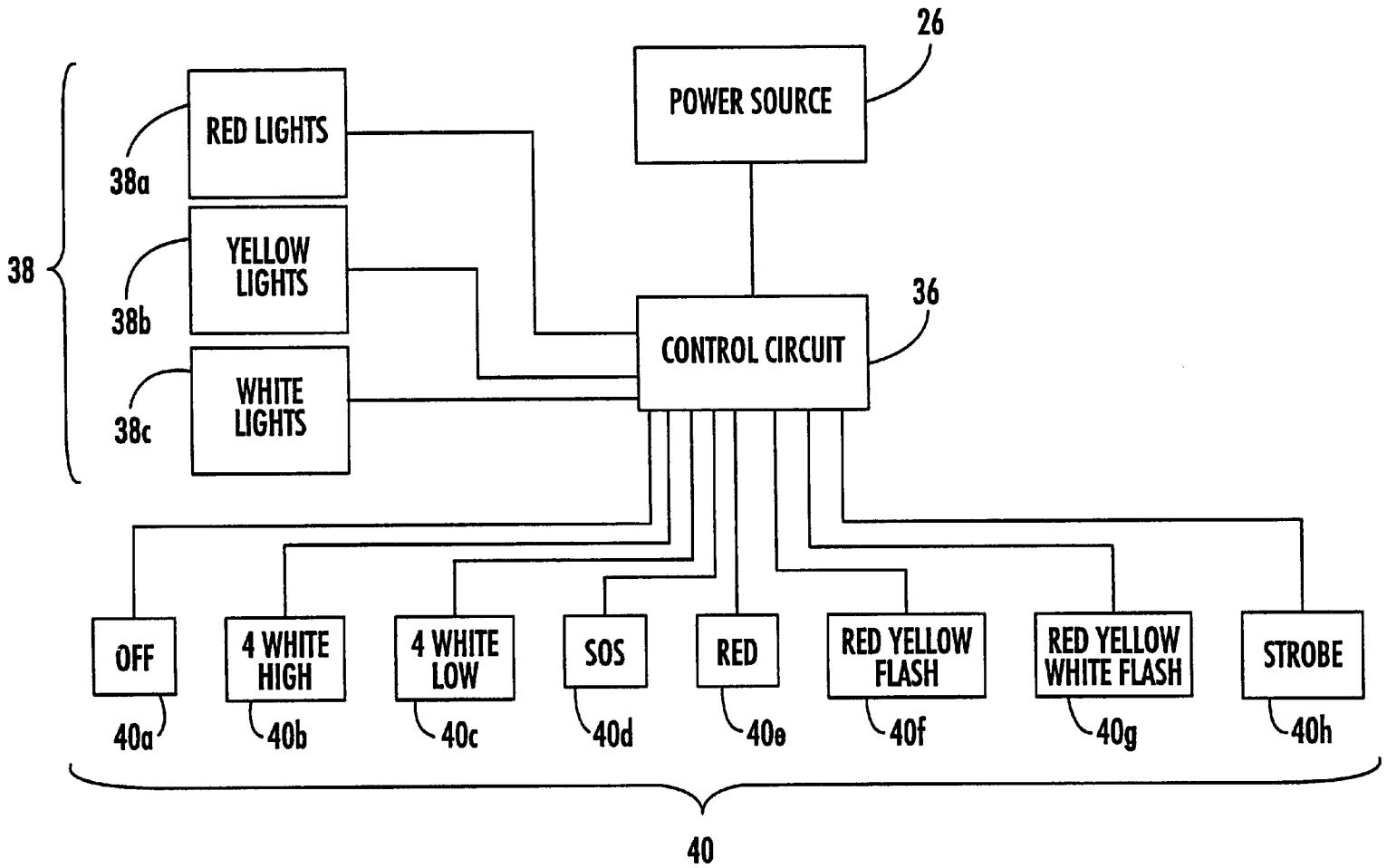
FIG. 6 is a schematic block diagram of the electronic components of the invention.

Referring to FIG. 6, the present invention further provides electronic control circuitry 36 on the base 14 that is in electrical communication with the battery 26, the lighting elements 38 divided into three color groups of red 38*a*, yellow 38*b* and white 38*c*, the contact elements 40*a*–40*h* and the switching element 16. The control circuitry 36 monitors the status of each of the switching positions 40*a*–40*h* on the base 14 to determine which switch positions 40*a*–40*h* are closed and which single switch position 40*a*–40*h* is open. The control circuit 36 has programming that includes a discrete set of instructions that corresponds to each of the possible switching configurations and uses the instruction set corresponding to each particular switch position to illuminate the lighting elements 38 in a particular manner or pattern. For example, the first position 40*a* has an instruction set that provides an off position where all non-control functions of the light 10 are de-energized. Other positions include illumination of a discrete number of the lighting elements 38 to provide a high 40*b* and low 40*b* illumination of the white lighting elements 38*c*. Further, the instructions included with other positions of the switch include programming that provides a blinking SOS pattern 40*d* of the white lights 38*c*, red light only 38*a*, red/yellow flash 40*f* where the control circuit 36 cycles an alternating red light 38*a*, yellow light 38*b* flashing pattern, a red/yellow/white flash 40*g* and a white light 38*c* strobe pattern 40*h*.

Figure 5:
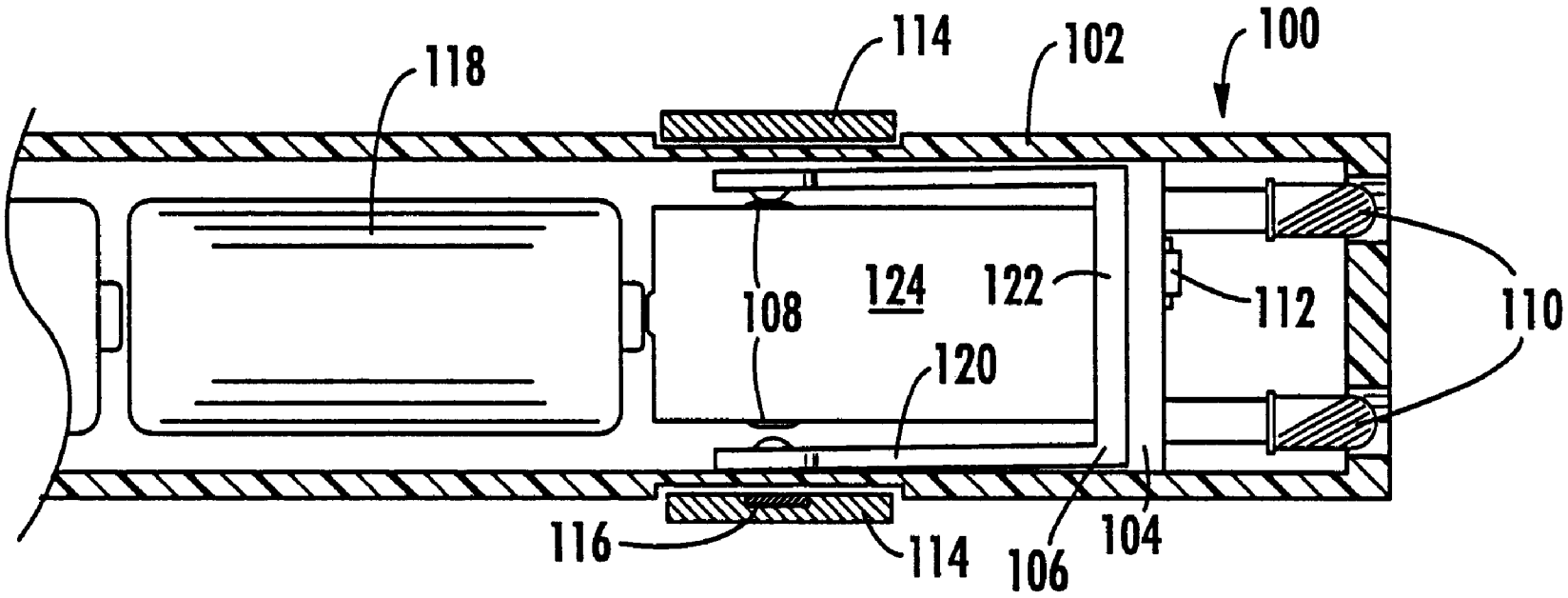
FIG. 5 is a cross sectional view of an alternative embodiment of the rotary switch of the present invention.

Now turning to FIG. 5, a second embodiment of the rotary switch of the present invention is shown. In this embodiment, the switch is again shown in connection with a flashlight 100, however the flashlight 100 is of a more traditional tubular configuration. As described above, the present invention includes an outer housing 102, a base 104, a contact element 106, contact pads 108, lighting elements 110, control circuitry 112, a rotatable actuator 114 that includes a magnet 116 and batteries 118. While all of the functional elements remain the same, the relationship between the functional elements is slightly varied. In this case, the base 14 is formed in a cylinder having a cylindrical outer surface. The contact pads 108 are arranged in a circular pattern or array around the circumference of the cylindrical outer surface. The hub 122 of the contact element 116 is mounted to the top end of the base 104 and the contact arms 120 of the contact element 116 are bent to a position that is substantially perpendicular to the hub 122. The contact arms 120 are spring biased inwardly where a cylindrical contact element 124 is placed having the contact element pads 108 thereon in locations that correspond to the contact arms 120. As can be seen in FIG. 5 the actuator 114 is provided as a ring that is rotatable around the outer housing 102 of the flashlight 100 and includes a magnet 116 mounted therein for opening the contact arm 120 located directly thereunder. In this manner, the switch operates exactly as described above. The magnet 116 lifts one contact arm 120 creating an open circuit. When the circuit opens, the control circuitry 112 performs the instructions that correspond to that discrete circuit location. When the magnet 116 is again rotated, that particular contact arm 120 is released closing the circuit at that location.

Alternately, the hub of the switch element may be rigidly connected to the base and the contact element pads may be provided on a flexible circuit tape structure that is placed on the interior of the flashlight barrel. In this configuration, each of the discrete switches would be spring biased to a normally open position. The magnet is installed in the rotatable sleeve on the exterior of the flashlight, allowing the user to selectably rotate the sleeve thus changing the contact configuration of the contact arms to a closed position. It should be understood that while a circular and cylindrical array is shown and illustrated herein, any desired switching configuration could be achieved. For example, a linear switch could also be provided where the hub is linear and the contact arms extend outwardly along one side. The actuator would then be slideably mounted above the switch element. Once assembled in this manner, it can be seen that the switch would then operate as described above.

It can therefore be seen that the present invention provides a rotary switch that has a compact profile, is lightweight and has a reduced number of operable components that allows the switch to be incorporated into a variety of devices. Further, the present invention can be modified to accommodate a number of different configurations to facilitate its incorporation into a broad variety of devices that require multi-functional switching. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A multifunctional switch assembly comprising:

a base having a array of electrically conductive contact pads;

an electrically conductive contact element including a hub portion, and an array of movable contact arms each having a first end connected to said hub and an opposite second end, said contact element being mounted to said base wherein said second ends of said contact arms are normally in electrically conductive engagement with respective ones of said contact pads on said base; and an actuator having a magnet mounted therein, said actuator being movably mounted adjacent said switch base and being movable relative to said base such that said magnet travels in a predetermined path above said second ends of said contact arms, said magnet being configured to lift a selected one of said second ends of said contact arms out of electrically conductive engagement with said corresponding contact pad when said magnet is positioned thereabove.

2. The switch assembly of claim 1, wherein said base is a circuit board and said contact pads are printed circuits on said circuit board.

3. The switch assembly of claim 2, further comprising:

control circuitry mounted on said circuit board, wherein said control circuitry monitors each of said contact pads, said control circuit performing a predetermined set of instructions when one of said contact arms is moved relative to one of said contact pads.

4. The switch assembly of claim 1, wherein said contact arms are disposed substantially in the plane of said hub in a normally closed position.

5. The switch assembly of claim 1, wherein said contact arms are disposed substantially perpendicular to the plane of said hub in a normally open position.

6. The switch assembly of claim 1, wherein said array of contact pads and said array of contact arms is a circular array.

7. A multifunctional light comprising:

a power source;

a plurality of light elements configured and arranged to provide multiple lighting patterns responsive to a plurality of different control instructions;

a multifunctional rotary switch assembly including, a base having a circular array of electrically conductive contact pads, an electrically conductive contact element including a hub portion, and a circular array of movable contact arms each having a first end connected to said hub and an opposite second end, said contact element being mounted to said base wherein said second ends of said contact arms are normally in electrically conductive engagement with said contact pads on said base, and a rotary actuator having a magnet mounted therein, said rotary actuator being rotatably mounted adjacent said switch base and being rotatable relative to said base such that said magnet travels in a circular path above said second ends of said contact arms, said magnet being configured to lift a selected one of said second ends of said contact arms out of electrically conductive engagement with said corresponding contact pad when said magnet is positioned thereabove; and a multifunctional control circuit in electrical communication with said plurality of lighting elements, said power source, said contact pads and said contact element, each corresponding pair of contact pad and contact arm having a respective control function, said multifunctional control circuit being configured to provide said respective control operation to said plurality of lights corresponding to a lifting of said respective contact arm.

8. The light assembly of claim 7, wherein said plurality of lighting elements is arranged in a circular array.

9. The light assembly of claim 8, wherein said array of lighting elements is an array of light emitting diodes.

10. The light assembly of claim 8, wherein said contact arms are disposed substantially in the plane of said hub in a normally closed position.

11. A multifunctional rotary switch assembly comprising:

a base having a circular array of electrically conductive contact pads;

an electrically conductive contact element including a hub portion, and a circular array of movable contact arms each having a first end connected to said hub and an opposite second end, said contact element being mounted to said base wherein said second ends of said contact arms are normally in electrically conductive engagement with said contact pads on said base; and a rotary actuator having a magnet mounted therein, said rotary actuator being rotatably mounted adjacent said switch base and being rotatable relative to said base such that said magnet travels in a circular path above said second ends of said contact arms, said magnet being configured to lift a selected one of said second ends of said contact arms out of electrically conductive engagement with said corresponding contact pad when said magnet is positioned thereabove.

12. The rotary switch assembly of claim 11, wherein said base has a planar surface, said contact pads being arranged in a circular array on said planar surface, and said contact element is mounted to said planar surface, and said contact arms extend radially outwardly from said hub and disposed substantially within a plane extending through said hub.

13. The rotary switch assembly of claim 11, wherein said base has a cylindrical outer surface, said, contact pads being arranged in a circular array around the circumference of said cylindrical surface, and said contact arms extend in a circular array around said the circumference of said cylindrical surface.

14. The rotary switch assembly of claim 11, wherein said base is a circuit board and said contact pads are printed circuits on said circuit board.

15. The rotary switch assembly of claim 14, further comprising:

control circuitry mounted on said circuit board, wherein said control circuitry monitors each of said contact pads, said control circuit performing a predetermined set of instructions when one of said contact arms is moved relative to one of said contact pads.

16. A multifunctional electronic device comprising:

a power source;

an electronic device configured and arranged to provide multiple functions responsive to a plurality of different control instructions;

a multifunctional rotary switch assembly including, a base having a circular array of electrically conductive contact pads, an electrically conductive contact element including a hub portion, and a circular array of movable contact arms each having a first end connected to said hub and an opposite second end, said contact element being mounted to said base wherein said second ends of said contact arms are normally in electrically conductive engagement with said contact pads on said base, and a rotary actuator having a magnet mounted therein, said rotary actuator being rotatably mounted adjacent said switch base and being rotatable relative to said base such that said magnet travels in a circular path above said second ends of said contact arms, said magnet being configured to lift a selected one of said second ends of said contact arms out of electrically conductive engagement with said corresponding contact pad when said magnet is positioned thereabove; and a multifunctional control circuit in electrical communication with said multifunctional electronic device, said power source, said contact pads and said contact element, each corresponding pair of contact pad and contact arm having a respective control function, said multifunctional control circuit being configured to provide said respective control operation to said electronic device corresponding to a lifting of said respective contact arm.

17. The device of claim 16, wherein said base has a planar surface, said contact pads being arranged in a circular array on said planar surface, and said contact element being mounted to said planar surface, said contact arms extending radially outwardly from said hub and disposed substantially within a plane extending through said hub.

18. The device of claim 16, wherein said base has a cylindrical outer surface, said contact pads being arranged in a circular array around the circumference of said cylindrical surface, and said contact arms extending in a circular array around said circumference of said cylindrical surface.

* * * * *